US007306364B2

(12) United States Patent
Born et al.

(10) Patent No.: US 7,306,364 B2
(45) Date of Patent: Dec. 11, 2007

(54) TIMEPIECE HAVING A MECHANICAL MOVEMENT ASSOCIATED WITH AN ELECTRONIC REGULATOR

(75) Inventors: Jean-Jacques Born, Morges (CH); Pierre-Andre Farine, Neuchatel (CH)

(73) Assignee: Asulab S.A., Marin (CH)

( * ) Notice: Subject to any disclaimer, the term of this patent is extended or adjusted under 35 U.S.C. 154(b) by 418 days.

(21) Appl. No.: 10/952,939

(22) Filed: Sep. 30, 2004

(65) Prior Publication Data

US 2005/0036405 A1 Feb. 17, 2005

(30) Foreign Application Priority Data

Oct. 1, 2003 (EP) ..... 03022031

(51) Int. Cl.
*G04B 25/02* (2006.01)
*G04B 1/00* (2006.01)

(52) U.S. Cl. ..... 368/148; 368/204

(58) Field of Classification Search ..... 368/161, 368/162, 163, 164, 170, 171, 127, 129, 140, 368/204, 203, 151
See application file for complete search history.

(56) References Cited

U.S. PATENT DOCUMENTS

| | | | | |
|---|---|---|---|---|
| 3,487,629 | A | 1/1970 | Takamune et al. | |
| 3,653,199 | A | 4/1972 | Inoki et al. | |
| 3,670,492 | A | 6/1972 | Takamune et al. | |
| 3,676,993 | A * | 7/1972 | Bergey et al. | 368/28 |
| 3,787,783 | A | 1/1974 | Ketterer | |
| 3,937,001 | A | 2/1976 | Berney | |
| 5,278,806 | A * | 1/1994 | Affolter | 368/204 |
| 5,517,469 | A | 5/1996 | Wiget | |
| 5,699,322 | A | 12/1997 | Born | |

(Continued)

FOREIGN PATENT DOCUMENTS

| | | |
|---|---|---|
| CH | 597 636 | 4/1978 |

(Continued)

OTHER PUBLICATIONS

European Search Report, completed May 14, 2004.

*Primary Examiner*—Vit Miska
*Assistant Examiner*—Jeanne-Marguerite Goodwin
(74) *Attorney, Agent, or Firm*—Griffin & Szipl, P.C.

(57) ABSTRACT

There is disclosed a wristwatch having a case containing a mechanical watch movement (10) driven by a spring barrel (14) and provided with a mechanical regulator with a balance and balance-spring, which is associated, via electromagnetic coupling, with an electronic regulator driven by a quartz resonator. The rim of the balance (13) is provided with a pair of permanent magnets (38, 39). The electronic regulator includes a fixed coil (12) arranged for cooperating with said magnets via electromagnetic coupling, a rectifier (58) provided with at least one capacitor, and a circuit (60) for enslaving the frequency of the mechanical regulator to the frequency of the oscillator by braking obtained by briefly short-circuiting the coil. In order to enable a common type of mechanical movement to be used, only the balance of which is altered, the electronic regulator is formed by a structural module (11) that is entirely separate from the mechanical watch movement (10). This module can be fixed to the movement plate, or, conversely, carried by the watch-case independently of said movement, in particular via a casing ring (26). Apart from the coil, all of the rest of the electronic module (11) is preferably located outside the mechanical movement.

12 Claims, 5 Drawing Sheets

U.S. PATENT DOCUMENTS

| | | | | |
|---|---|---|---|---|
| 5,740,131 | A | 4/1998 | Bernasconi | |
| 5,751,666 | A | 5/1998 | Farine et al. | |
| 5,835,456 | A | 11/1998 | Farine et al. | |
| 6,021,097 | A * | 2/2000 | Kanno et al. | 368/64 |
| 6,023,446 | A | 2/2000 | Farine et al. | |
| 6,113,259 | A | 9/2000 | Farine et al. | |
| 7,016,265 | B2 * | 3/2006 | Born et al. | 368/163 |

FOREIGN PATENT DOCUMENTS

| | | | |
|---|---|---|---|
| DE | 39 03 706 | A1 | 8/1989 |
| EP | 0 806 710 | A1 | 11/1997 |
| EP | 1 093 036 | A1 | 4/2001 |
| EP | 1 143 307 | A1 | 10/2001 |
| GB | 880 121 | A | 10/1961 |

* cited by examiner

TIMEPIECE HAVING A MECHANICAL MOVEMENT ASSOCIATED WITH AN ELECTRONIC REGULATOR

This application claims priority from European Patent Application No 03022031.3 filed Oct. 1, 2003, the entire disclosure of which is incorporated herein by reference.

BACKGROUND OF THE INVENTION

The present invention concerns a timepiece having a case containing a mechanical watch movement driven by a spring and provided with a mechanical regulator, which is associated, via electromagnetic coupling, with an electronic regulator housed in the case, wherein:

the mechanical regulator includes a balance spring associated with a balance rotatably mounted between a plate and a balance-cock for rotation, the balance having a rim provided with at least one pair of permanent magnets whose directions of magnetisation are substantially parallel to the axis of the balance, but in opposite directions to each other; and the electronic regulator includes at least one fixed coil arranged for cooperating with said magnets by electromagnetic coupling, a rectifier supplied by said coil and provided with at least one capacitor, and an enslaving circuit provided with an oscillator for enslaving the frequency of the mechanical regulator to the oscillator frequency by means of said electromagnetic coupling.

The principle of a mechanical clockwork-movement powered by a spring and regulated by an electronic circuit was disclosed by J. C. Berney in U.S. Pat. No. 3,937,001. In a basic version, it is implemented by using an electric generator whose rotor meshes directly with the gear train of the mechanical movement and is thus continuously rotating. The speed of the rotor is stabilised at the appropriate rotational frequency for indicating the time, by means of an electromagnetic braking device regulated by the electronic circuit, which enslaves this frequency to that of an oscillator driven by a quartz resonator. Improvements to timepieces arranged in this manner are disclosed in U.S. Pat. Nos. 5,517,469, 5,699,322, 5,740,131, 5,751,666, 5,835,456, 6,113,259 and 6,023,446 by the same Applicant as the present Patent Application, which are incorporated here by reference insofar as they disclose the electronic circuits that can also be used with the present invention, with any adaptations required due to the fact that the electric generators are different.

The same principle forms the subject of the subsequent DE Patent Application No. 39 03 706, which schematically shows various types of electric generators that can be used in this context, including in combination with an oscillating pendulum.

FIG. 3 of the aforecited U.S. Pat. No. 3,937,001 illustrates schematically a variant which corresponds to the preamble hereinbefore, i.e. in which the rotating part of the electric generator driven by the spring of the clockwork-movement is formed by the balance of a clockwork resonator of the sprung balance type. In other words, the generator rotor of the basic version is replaced by an oscillating element, which is the balance. The latter carries two juxtaposed magnets having opposite polarities to each other, and passing opposite a fixed induction coil during oscillation of the balance. However, no construction is proposed for such a balance generator in this Patent, nor, to our knowledge, has one been made since. One particular problem, which arises in such a watch balance generator, lies in the configuration of the magnetic circuit ensuring the coupling between the fixed coil and the balance magnets, given the neighbouring metallic weights of the mechanical clockwork-movement.

A similar problem arises in electric watches of the type in which the oscillating movement of a sprung balance assembly is maintained not by a motor spring, but by electric pulses applied to at least one fixed coil arranged opposite the trajectory of the magnets, for example as is described in U.S. Pat. No. 3,487,629 and U.S. Pat. No. 3,653,199. To prevent the closed magnetic circuit passing in the plate or other metallic elements of the mechanical movement, the balance includes two parallel wheels arranged respectively on either side of the fixed coils. The magnets are arranged facing each other on the two wheels. According to U.S. Pat. No. 3,487,629, each wheel is made of a magnetically permeable material, for example soft steel, in order to close the magnetic circuit behind the two magnets that it carries. U.S. Pat. No. 3,670,492 provides another solution, consisting in using non ferrous metal balance wheels, as in conventional clockwork-movements, and adding a metal magnet support assembly behind the pair of magnets of each wheel.

The use of such a two-wheel balance in a watch of the type concerned by the present invention would be very disadvantageous, mainly because such a balance would be too cumbersome and would have too high a moment of inertia.

Indeed, the present invention aims to use as far as possible a mechanical watch movement of usual construction, simply adding an electronic regulator, which cooperates with the balance of the mechanical regulator owing to the addition of a pair of magnets on the balance. In order to do this, the only element that must necessarily be altered in the mechanical movement is the balance, because of the addition of the magnets. The natural oscillation frequency of the sprung balance assembly after alteration must be slightly higher than the original frequency, so that the electronic regulator can stabilise it by briefly braking the balance, but the frequency thus stabilised must be equal to the original frequency. It is an object of the invention to conserve, as far as possible, the other elements of the mechanism, in order to use an existing mechanical movement or similar one, for reasons of construction cost and rationalising the supply of parts.

If the conventional balance of a mechanical movement had to be replaced by a two-wheel balance in accordance with the aforecited Patents, the largest axial dimensions of the latter would require completely resizing the movement, which would become much thicker.

Another type of combination of a mechanical clockwork-movement with a regulation device by electromagnetic means forms the subject of a group of Patent Applications by Seiko Instruments Inc., particularly EP Patent Application Nos. 1 093 036 and 1 143 307, and includes a multi-polar annular magnet, mounted on the balance and cooperating with one or several fixed induction coils. These are connected by conductive wires to a switching mechanism located on the balance-cock and operating via contact with the balance spring as a function of the oscillation amplitude of the balance. This contact short-circuits the coils to brake the balance when the oscillation amplitude exceeds a predefined threshold. These coils are placed on the plate of the movement, opposite the balance rim. In a particular construction disclosed in EP Patent Application No. 1 143 307, they are grouped on a printed circuit board to form an electric circuit unit, which is installed at a location arranged for this purpose on the plate.

Since the function of such an arrangement is not to generate electric energy, but only to make the balance waste energy, no great importance is attached to the energy conversion efficiency, or to the configuration of the magnetic circuit. The presence of the coil, and other elements of the clockwork-movement in proximity to the induction coils is not inconvenient in this application, whereas it can be when, in the case of the present invention, an electronic oscillator is being powered consuming the least possible amount of mechanical energy supplied by the spring.

SUMMARY OF THE INVENTION

It is an object of the invention to make a timepiece of the type indicated in the preamble by arranging the electronic regulator in a way that enables a mechanical watch movement to be used with the least possible alterations, while ensuring efficient electromagnetic coupling between the fixed part and the mobile part of the electric generator. It is an additional object to arrange the electronic generator in a compact shape, if possible allowing it to be housed in a case of the same size as a case for receiving only the mechanical movement.

Thus, a basic feature of a timepiece according to the invention lies in the fact that the electronic regulator is formed by a structural module that is entirely separate from the mechanical watch movement. Depending upon the particular embodiment, this module can be fixed on a plate of said movement, or conversely, be carried by the case independently of said movement.

In a preferred embodiment, the electronic regulator includes a printed circuit board carrying at least the rectifier, a quartz resonator and the enslaving circuit, and preferably also the coil. Thus, the electronic regulator is formed by an autonomous and entirely separate structure from the mechanical movement, which, in its entirety, except for the coil, can be located outside the mechanical movement. For example, this module can be fixed to a casing ring which surrounds the mechanical movement. This allows the electronic module to be easily mounted in a watchcase after the mechanical movement has been fitted.

Other features and advantages of the present invention will appear hereinafter in the detailed description of two embodiments, given by way of non-limiting example with reference to the annexed drawings.

DETAILED DESCRIPTION OF THE INVENTION

Reference will be made first of all to FIGS. 1 to 5, which show schematically the main elements of a wristwatch according to the invention, in a first embodiment. The watch includes a self-winding mechanical watch movement 10, of a common type such as the Eta 2824 calibre, and an electronic regulator made in the form of an electronic module 11 including a coil 12 which cooperates via electromagnetic coupling with balance 13 of mechanical movement 10, this balance being the only part altered with respect to the original movement.

Figure 1:
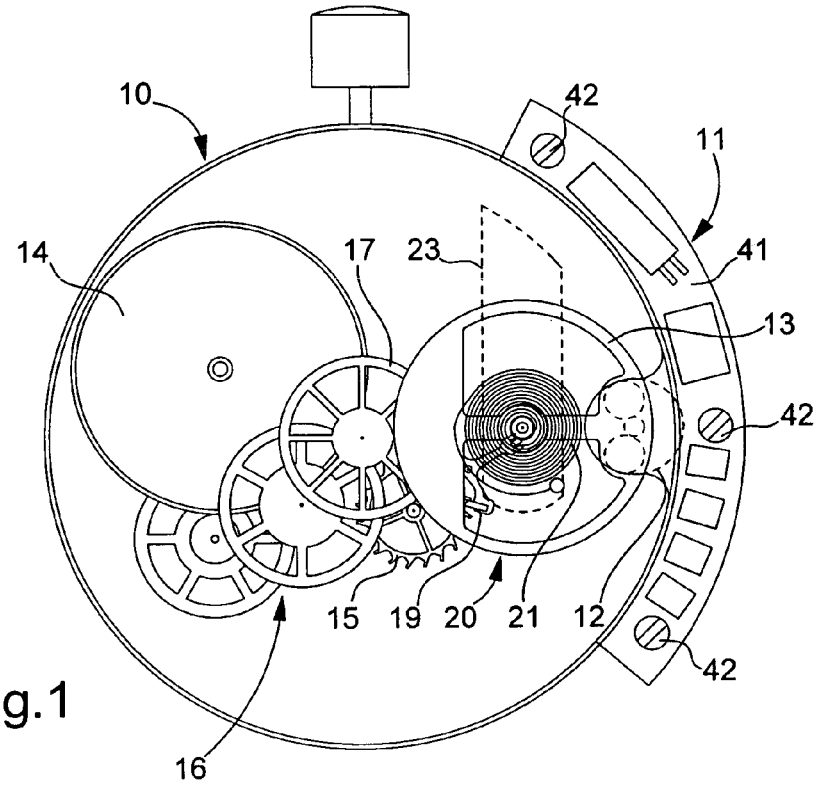
FIG. 1 shows the arrangement of a mechanical clockwork-movement associated with an electronic regulator module in a watch according to the principles of the present invention in a first embodiment, the assembly being seen from the side opposite the plate of the mechanical movement.

Since movement 10 is well known, only a few of its components have been shown in the drawings, particularly a spring barrel 14 which drives an escapement wheel 15 via a gear train 16 including a central second wheel 17, which drives hands 18 of the watch. The escapement includes a pallet 19 giving pulses to the mechanical regulator 20, which includes balance 13 and a balance spring 21, the regulator being rotatably mounted between plate 22 of movement 10 and a balance-cock 23 fixed to the plate. In FIG. 1, balance-cock 23 is transparent in order to clarify the drawing. As usual, plate 22 (FIG. 4) of movement 10 is located in the watchcase on the side of dial 24 and it is fixed by clamps 25 to a casing ring 26, which surrounds movement 10 and which is itself mounted inside middle part 27 of the watchcase. Thus, balance-cock 23 and the other bridges of movement 10, and oscillating weight 28 of the self-winding device, are on the side of removable back cover 29 of the watchcase. The top of the case is formed by a crystal 30 mounted on middle part 27, either directly, or via a bezel.

Movement 10 is designed to operate with a usual oscillating frequency of regulator 20, usual frequencies generally being comprised between 2.5 Hz and 5 Hz, and preferably equal to 3 Hz or 4 Hz. In the examples described here, the theoretical oscillation frequency of regulator 20 is 4 Hz.

Figure 2:
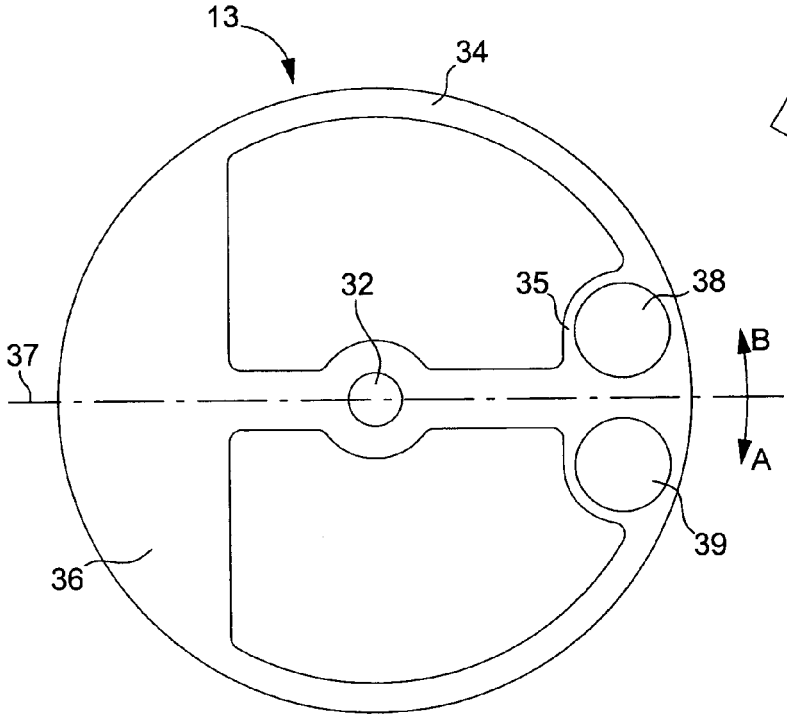
FIG. 2 shows the balance of the mechanical movement in more detail.

FIG. 2 shows balance 13 in more detail, seen from the side of balance-cock 23. The balance includes a pin 32, whose ends are mounted in bearings carried by plate 22 and balance-cock 23, and a flat wheel having a rim 34, provided with two enlarged parts 35 and 36 each centred on a diametral axis 37 of the balance wheel. Part 35 carries two magnets 38 and 39, whereas part 36 forms a counterweight such that the centre of gravity of the balance is at the centre of its pin 32. Each of magnets 38 and 39 is formed by a small cylindrical disc magnetised parallel to balance pin 32, but with opposite polarities from one magnet to the other in order to create field lines which pass through the two magnets. The magnets are fixed on part 35 of the rim, for example glued, on the side opposite plate 22. Rim 34 of the balance is made of a magnetic metal such as iron-nickel, such that its part 35 forms a magnetic shunt which closes the magnetic field created by magnets 38 and 39 on the side of plate 22.

With respect to the balance of the original movement, balance 13 can have approximately the same external dimensions and the same mass. For example, the thickness of rim 34 can be 0.15 mm and that of the magnets 0.25 mm, such that the total thickness of 0.4 mm is the same as that of the balance rim of the original movement. Mechanical regulator 20 is arranged to have a slightly higher natural oscillation frequency (for example approximately 1%) than the theoretical frequency of 4 Hz over the entire useful winding range of spring 54, so that stabilisation of its real frequency by the enslaving circuit can occur just by small braking pulses. In this regard, a simple solution consists in using an identical balance spring to that of the original movement and giving the balance a slightly lower moment of inertia. The rate of the mechanical regulator can also be adjusted in the conventional manner, by means of the index.

Preferably, mechanical regulator 20 is mounted so that, in a neutral position where balanced spring 21 is at rest, diametral axis 37 and thus the pair of magnets 38 and 39 are opposite coil 12. In operation, balance 13 oscillates on either side of this neutral position as arrows A and B of FIG. 2 indicate. As the instantaneous speed of the balance in maximum when it passes by its neutral position, the efficient induced voltage in coil will be maximized if the pair of magnets passes in front of the coil at this instant. The amplitude of the oscillator of about ±270 degrees when the barrel spring is completely wound in a classical movement can be somewhat reduced here for example to about ±180 degrees by the energy consumption of the electric generator.

In order to obtain a higher output voltage, two or several series-connected fixed coils 12 can be provided, cooperating with a corresponding number of pairs of magnets on balance 13.

Figure 3:
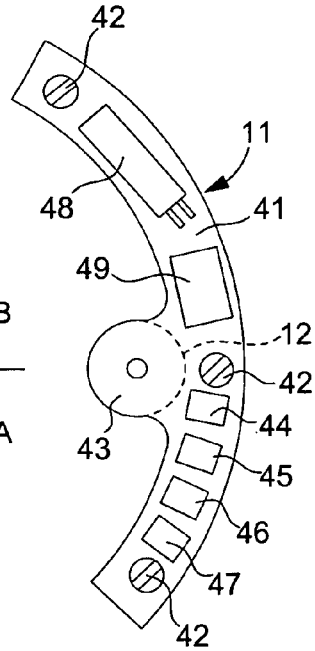
FIG. 3 shows the electronic regulator module in more detail.

FIG. 3 shows the external appearance of electronic module 11, whose circuits will be described hereinafter with reference to FIG. 6. Its components are carried by a printed circuit board 41 having the general shape of a circle segment, in order to be positioned against the lower face of casing ring 26, to which it is fixed by screws 42. The components shown in FIG. 3 include coil 12 mounted on a part 43 of board 41 that is enlarged in the direction of the inside of the watch, a pair of Schottky diodes 44 and 45, a pair of capacitors 46 and 47, a quartz resonator 48 and an integrated circuit 49. Coil 12 is mounted on the top face of board 41, which holds it in a fixed position, which is chosen such that a slight gap exists between coil 12 and magnets 38 and 39, typically of the order of 0.2 mm to ensure a strong enough electromagnetic coupling. In the example shown here, the other elements 44 to 49 are mounted on the bottom face of board 41, so that they are in usually free space 50 between casing ring 26 and back cover 29 of the case. However, these elements or certain of them could also be arranged on the top face of board 41, provided that appropriate recesses are arranged in casing ring 26.

In a variant that is not shown, coil 12 could be mounted on a separate support instead of being directly on board 41. The latter could then be replaced by a flexible film, which could be glued underneath casing ring 26.

Figure 4:
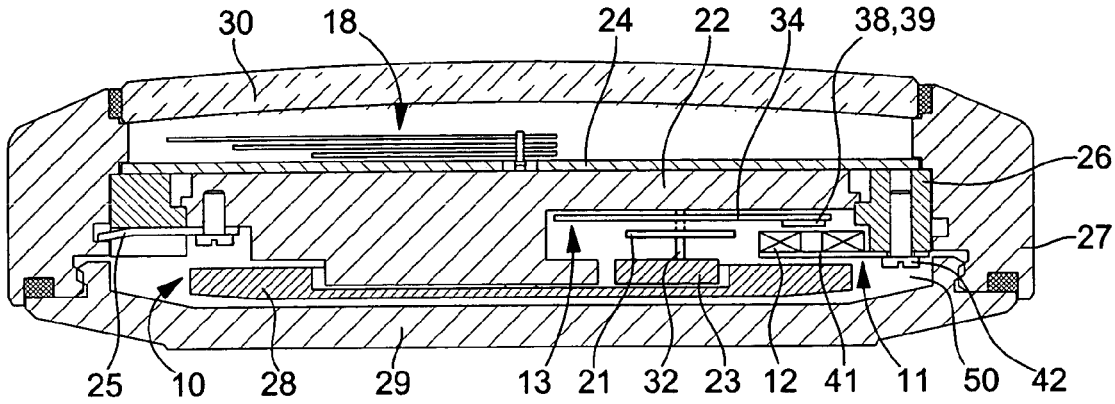
FIG. 4 is a schematic vertical cross-section of a self-winding watch including the elements shown in FIG. 1.
Figure 5:
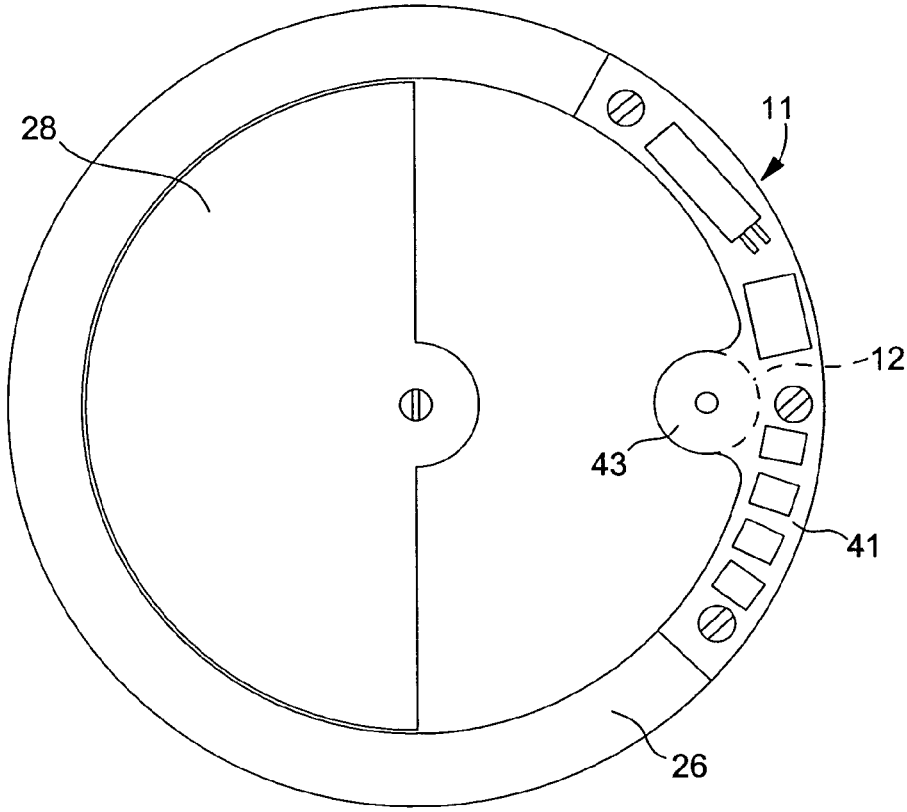
FIG. 5 is a bottom view showing the oscillating weight of the watch of FIG. 4.

Upon examining FIGS. 1 and 4 in particular, it will be noted that the configuration of electronic module 11 enables this module to be housed in the watchcase entirely outside mechanical movement 10, with the exception of coil 12, which has to be situated facing the rim of balance 13. However, this coil occupies a space that, in usual mechanical movements, is generally free between balance spring 21 and the periphery of the movement. In certain types of self-winding movements, it may happen that this space is partially occupied by the thick peripheral part of oscillating weight 28. If one wishes to use the present invention with such a movement, this part of the oscillating weight only has to be slightly altered in order to release sufficient height for coil 12. Such an alteration is easy and has no repercussions on the other components of the movement, provided that the alteration to the oscillating weight does not reduce the winding torque. The watchcase can be identical to that which receives the original mechanical movement.

The operation of the watch illustrated in FIGS. 1 to 5 will now be described with particular reference to FIGS. 6 to 7. In FIG. 6, mechanical movement 10 is powered by barrel spring 54, forming the source of mechanical energy that drives balance 13 via gear train 16 and escapement 55, the gear train also driving hands 18. Once can also see the pair of magnets 38 and 39 of balance 13 and coil 12, which forms an electric generator 56 with the balance.

Figure 6:
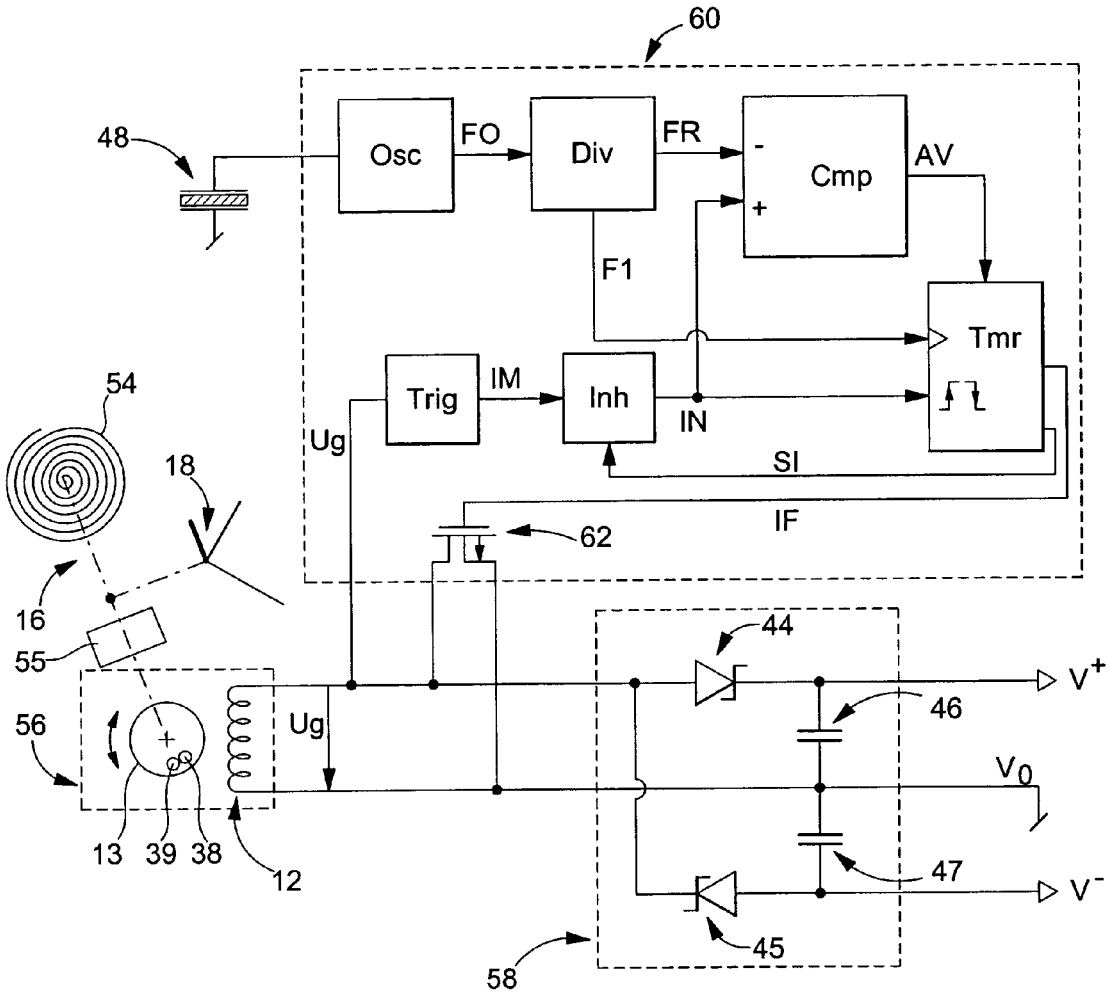
FIG. 6 is an operating diagram of the watch of FIG. 4.

The circuits of electronic module 11 described hereinbefore are shown in FIG. 6 and include coil 12, a rectifier 58 and an enslaving circuit 60 that is made in integrated circuit 49 shown in FIG. 3. Rectifier 58 includes the two Schottky diodes 44 and 45 and the two capacitors 46 and 47, which are preferably of the ceramic type. The inputs of the rectifier are connected to the terminals of coil 12 and its outputs V+, V0 and V− power enslaving circuit 60 owing to the electric energy generated by generator 56 and stored in the two capacitors. A minimum value of 0.6 V of rectified voltages V+ and V−, corresponding to the minimum admissible oscillation amplitude of balance 13, is sufficient for integrated circuit 49 to operate, particularly if the latter is made in SOI technology.

Figure 7:
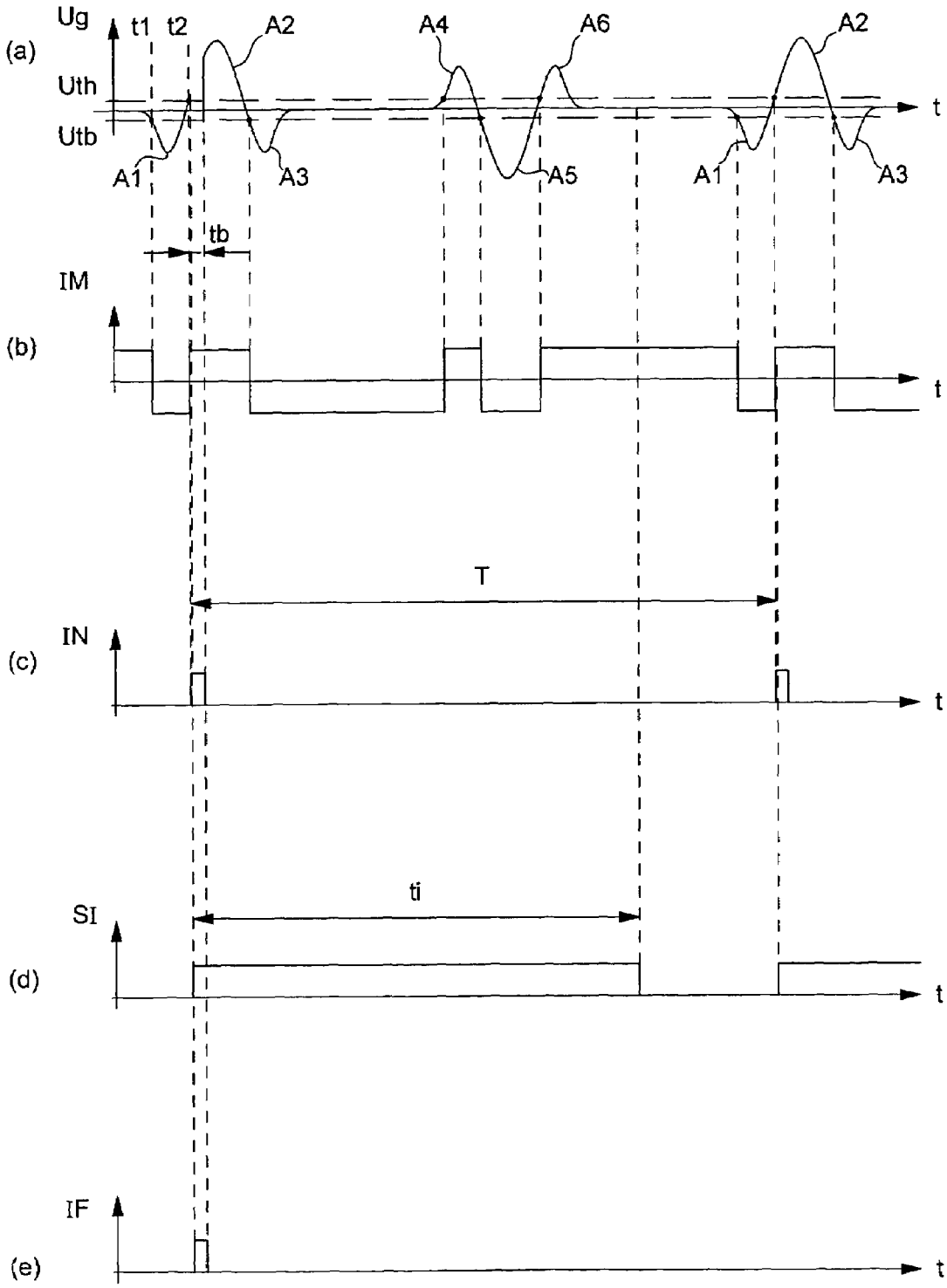
FIG. 7 shows timing diagrams of certain signals mentioned in FIG. 6.

Timing diagram (a) of FIG. 7 shows the evolution of the voltage Ug induced across the terminals of coil 12 by three alternations of balance 13, each alternation including one passage of the pair of magnets 38 and 39 in front of the coil. The first passage, during the movement of the balance in a first direction, successively generates three main alternations of voltage Ug, namely one negative alternation A1, a positive alternation A2 and a negative alternation A3, then the voltage remains substantially zero while the movement of the balance is completed and changes direction. The interruption in the voltage during a brief period tf corresponds to braking which will be described hereinafter. The passage of the magnets when the balance returns causes three other main alternations of voltage Ug, namely a positive alternation A4, a negative alternation A5 and a positive alternation A6, then the voltage again remains substantially zero until the next passage in the first direction, when voltage Ug restarts its cycle having a period T, which is the real oscillation period of the balance.

Enslaving circuit 60 includes a reference oscillator Osc, driven by quartz resonator 48 to form a time base. Circuit 60 is arranged for enslaving the oscillation frequency of balance 13 to a reference frequency FR derived from oscillator Osc, by carrying out brief oscillator braking operations by short-circuiting coil 12 by means of an electronic switch such as a transistor 62, in accordance with the principle described in the aforementioned U.S. Pat. Nos. 5,517,469 and 5,740,131. Given that enslaving circuit 60 shown in FIG. 6 is practically the same as that described in EP Patent No. 806 710 (corresponding to U.S. Pat. No. 5,740,131) to which the reader can refer for more details, it will be described in a simplified manner here, while explaining in detail the differences resulting from the present invention.

Oscillator Osc delivers the signal FO, having for example a frequency of 32768 Hz, to a divider circuit Div, one output of which delivers a signal at the reference frequency FR=4 Hz to the negative input of a comparator circuit Cmp, whereas another output delivers an intermediate frequency signal F1, for example at 4096 Hz, as clock signal to a timer Tmr. One output of timer Tmr delivers, when necessary, a braking pulse IF of duration tf, which makes transistor 62 conductive to short-circuit coil 12. During this period, voltage Ug falls to a value close to zero, as can be seen in timing diagram (a) of FIG. 7.

Voltage Ug across the terminals of coil 12 is delivered to means for measuring its frequency, including a Schmitt trigger referenced Trig and an inhibition circuit Inh. As can be seen in timing diagrams (a) and (b) of FIG. 7, trigger Trig delivers a detection signal IM to the inhibition circuit, which changes sign each time that the absolute value of voltage Ug is sufficiently raised to cross the high voltage threshold Uth or low voltage threshold Utb of the trigger. The role of the inhibition circuit Inh is to deliver, for each oscillation period of balance 13 and thus for one out of two passages of the pair of magnets 38, 39 opposite coil 12, a measuring pulse IN to the positive input of comparator circuit Cmp and to timer Tmr. The measuring pulses IN, shown in timing diagram (c) of FIG. 7, thus theoretically have a frequency f of 4 Hz and a period T of 250 ms, but one can also envisage delivering a measuring pulse IN for each passage of the magnets opposite the coil, thus at a theoretical frequency of 8 Hz.

In the present example, one has chosen to carry out the braking step during the largest alternation A2 of voltage Ug and not during the first alternation A1, because this is shorter. Consequently, inhibition circuit Inh is arranged not to consider the first change of state of signal IM at the instant t1 indicated in FIG. 7, but only the second at instant t2, to deliver the measuring pulse IN. Otherwise, one could also envisage braking during the first alternation A1.

The function of comparator circuit Cmp is to indicate, via its output signal AV, whether the oscillation of balance 13 is ahead with respect to that of oscillator OSC. This comparator can be for example a reversible counter, which aggregates the difference between the number of measuring pulses IN received at its positive input and the number of reference pulses received at frequency FR at its negative input. Timer Tmr receives signal AV and, if the latter indicates that the balance is ahead, it delivers a brief braking signal IF which temporarily makes transistor 62 conductive, which brakes the balance as explained hereinbefore. The start of braking signal IF is preferably slightly delayed with respect to the appearance of measuring pulse IN, as is seen in FIG. 7, and duration tf of braking signal IF is predetermined such that braking occurs in an initial part of the largest alternation A2 of voltage Ug, but not in the duration where the voltage is highest, since it is at that moment that electric generator 56 can supply most energy to capacitors 46 and 47. At the moment when it delivers braking signal IF, timer Tmr starts to deliver to circuit Inh an inhibition signal SI, whose function is to prevent transmission of another measuring pulse IN before the next oscillation period of the balance. As can be seen in timing diagram (d) of FIG. 7, duration ti of inhibition signal Si is slightly shorter than period T, for example 80% of T.

The timing diagrams of FIG. 7 correspond to the case in which a single braking operation of duration tf is enough to return the differential count to zero in comparator Cmp, such that there is no new braking during the next voltage alternation A2. In the opposite case, braking will occur at each successive period until the number of periods of balance 13 is equal to that of electronic oscillator OSC.

The particular structure of enslaving circuit 69 described hereinbefore and the functions of its various components are not critical for implementing the present invention, since they can be made in a different way. One could also make the improvements to them provided in the aforecited Patents by the same Applicant. In particular, the improvement described in U.S. Pat. No. 6,113,259 can be advantageously applied in combination with the present invention. This involves applying electric drive pulses to the electromechanical converter formed by electric generator 56, in order to maintain a sufficient oscillation amplitude for the balance so that escapement 55 operates properly when the torque provided by spring 54 goes below a limit value, until the spring is rewound, for example by self-winding. An accumulator capable of providing the electric energy used to overcome temporarily the lack of mechanical energy, should then be added.

Figure 8:
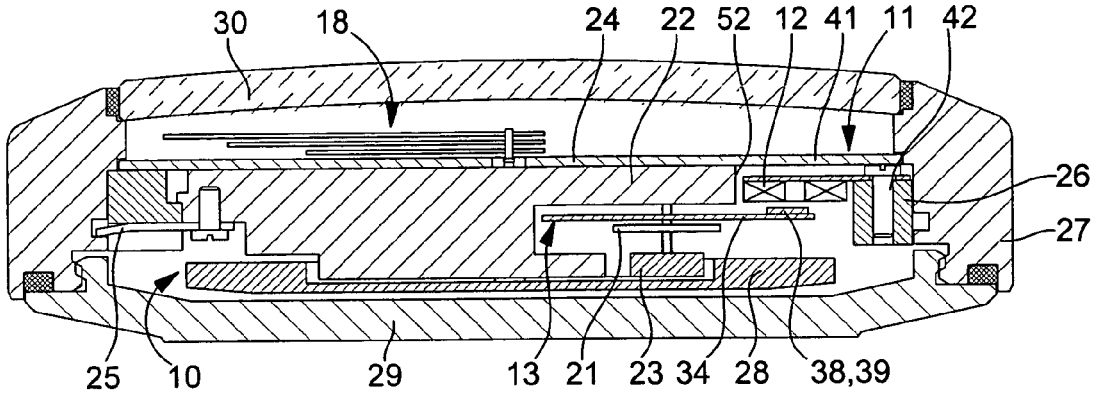
FIG. 8 is a similar view to FIG. 4, showing a second embodiment.

FIG. 8 is a similar cross-section to FIG. 4 and shows a second embodiment of a watch according to the invention, of which only the differences in relation to the example described hereinbefore will be described, reusing the same reference numerals for the corresponding elements. In this case, instead of being placed against the bottom face of casing ring 26, printed circuit board 41 of electronic module 11 is located on the top face of said ring, i.e. on the side of dial 24. Coil 12 and the other components mounted on board 41 are placed on the bottom face of the card, said components occupying recesses (not shown) arranged in casing ring 26. An insulating sheet can be inserted between said ring and the board in the zones where the board is fixed to the ring by screws 42. The operation of the watch is the same as in the first embodiment.

Balance 13 differs from that of the preceding example solely in that magnets 38 and 39 are placed on the top face of the rim, to pass close to coil 12 located above. Depending upon the original movement used, it may be necessary to make a cut out portion 52 in plate 22 to leave room for coil 12. This can generally be achieved without any difficulty, since, if the plate of usual movements extends into this region, it is only to shoulder the dial and it usually does not carry there any actual component of the movement.

In this second example, the only alterations to be made to mechanical watch movement 10 consist in changing the balance and possibly arranging cut out portion 52 in the plate. No alteration is required for oscillating weight 28 of the automatic winding device. Casing ring 26 will obviously have to be adapted to receive electronic module 11. The watchcase can be identical to that which receives the original mechanical movement.

According to a variant, which is not illustrated here, the arrangement shown in FIG. 8 can be altered in order to fix electronic module 11 to plate 22 instead of to casing ring 26. For this purpose, cut out portion 52 can be replaced by a recess that occupies only part of the thickness of the plate. Fixing to the plate has the advantage of positioning coil 12 with great precision in relation to balance 13.

Although the examples described here relate to a self-winding wristwatch, the application of the present invention is not limited to this subject and extends to any type of timepiece having a mechanical movement provided with a sprung-balance regulator.

What is claimed is:

1. A timepiece having a case containing a mechanical watch movement driven by a spring and provided with a mechanical regulator, which is associated, via electromagnetic coupling, with an electronic regulator housed in the case, wherein said mechanical regulator includes a balance spring associated with a balance having a rotational axis and a rim provided with at least one pair of permanent magnets whose directions of magnetisation are substantially parallel to the rotational axis of the balance, but in opposite directions to each other, wherein said electronic regulator includes at least one fixed coil arranged for cooperating with said magnets via electromagnetic coupling, a rectifier powered by said coil and provided with at least one capacitor, and an enslaving circuit provided with an oscillator having a frequency and arranged for enslaving the frequency of the mechanical regulator to the frequency of the oscillator by means of said electromagnetic coupling, and wherein said electronic regulator is formed by a structural module that is entirely separate from the mechanical watch movement.

2. The timepiece according to claim 1, wherein said module is fixed onto a plate of said movement.

3. The timepiece according to claim 1, wherein said module is carried by the case independently of said movement.

4. The timepiece according to claim 1, wherein the electronic regulator includes a printed circuit board carrying at least the rectifier, a quartz resonator and the enslaving circuit.

5. The timepiece according to claim 4, wherein the printed circuit board further carries the coil.

6. The timepiece according to claim 4, wherein, except for the part thereof carrying the coil when required, the printed circuit board has the shape of a segment of a circle.

7. The timepiece according to claim 4, wherein, except for the part thereof carrying the coil when required, the printed circuit board is located outside the mechanical watch movement.

8. The timepiece according to claim 7, wherein the printed circuit board is fixed to a casing ring, which surrounds the mechanical watch movement.

9. The timepiece according to claim 8, wherein the printed circuit board is placed on a top face of the casing ring, on the side of a dial of the timepiece.

10. The timepiece according to claim 8, wherein the printed circuit board is placed on a bottom face of the casing ring, on the side of a removable back cover of the timepiece.

11. The timepiece according to claim 1, wherein the mechanical watch movement is a self-winding movement, including an oscillating weight arranged for rotating about a central axis of the movement, and wherein the coil extends at least in part between the rim of the balance and the trajectory of a peripheral part of the oscillating weight.

12. The timepiece according to claim 11, wherein the electronic regulator includes a printed circuit board carrying at least the rectifier, a quartz resonator and the enslaving circuit and in that the quartz resonator is disposed on the printed circuit board on the back cover side of the case and is located at substantially the same level as the peripheral part of the oscillating weight.

* * * * *